US007076833B2

(12) United States Patent
Murayama et al.

(10) Patent No.: US 7,076,833 B2
(45) Date of Patent: Jul. 18, 2006

(54) AUTOMOBILE DOOR CHECKER

(75) Inventors: Yuji Murayama, Sakado (JP); Junichi Yoshioka, Wako (JP)

(73) Assignees: Rikenkaki Kogyo Kabushiki Kaisha, Sakado (JP); Honda Motor Co., Ltd., Tokyo (JP)

( * ) Notice: Subject to any disclaimer, the term of this patent is extended or adjusted under 35 U.S.C. 154(b) by 43 days.

(21) Appl. No.: 10/824,184

(22) Filed: Apr. 14, 2004

(65) Prior Publication Data

US 2004/0251696 A1 Dec. 16, 2004

(30) Foreign Application Priority Data

Apr. 17, 2003 (JP) ..... 2003-113398

(51) Int. Cl.
*E05F 5/02* (2006.01)

(52) U.S. Cl. ..... 16/82; 16/86 C

(58) Field of Classification Search ..... 16/82, 16/86 A, 86 B, 86 C; 292/270, 269, 268, 292/266; 296/146.11, 146.12
See application file for complete search history.

(56) References Cited

U.S. PATENT DOCUMENTS

| | | | | |
|---|---|---|---|---|
| 2,268,976 | A * | 1/1942 | Westrope | 16/86 C |
| 2,268,977 | A * | 1/1942 | Westrope | 16/86 C |
| 4,332,056 | A * | 6/1982 | Griffin et al. | 16/341 |
| 5,173,991 | A * | 12/1992 | Carswell | 16/86 A |
| 5,474,344 | A * | 12/1995 | Lee | 292/262 |
| 5,862,570 | A * | 1/1999 | Lezuch et al. | 16/82 |
| 6,065,185 | A * | 5/2000 | Breed et al. | 16/86 C |
| 6,467,126 | B1 * | 10/2002 | Yezersky et al. | 16/86 C |
| 6,842,943 | B1 * | 1/2005 | Hoffmann et al. | 16/82 |

FOREIGN PATENT DOCUMENTS

| | | | |
|---|---|---|---|
| DE | 4325550 | A1 * | 10/1994 |
| DE | 10013583 | A1 * | 9/2001 |
| EP | 326823 | A1 * | 8/1989 |
| EP | 574722 | A1 * | 12/1993 |
| EP | 574723 | A1 * | 12/1993 |
| EP | 959210 | A1 * | 11/1999 |
| JP | 3-13392 | | 2/1991 |
| JP | 07257186 | A * | 10/1995 |
| JP | 2004044187 | A * | 2/2004 |
| JP | 2004100279 | A * | 4/2004 |

* cited by examiner

*Primary Examiner*—Chuck Y. Mah
(74) *Attorney, Agent, or Firm*—Carrier, Blackman & Associates, P.C.; Joseph P. Carrier; William D. Blackman

(57) ABSTRACT

An automobile door checker includes a check plate, a shoe holder housed in a case, a shoe that is held by the shoe holder and the shoe slides on the check plate accompanying relative movement between the case and the check plate, and a check spring that resiliently urges the shoe holder toward the check plate in order to press the shoe against the check plate. The shoe is axially supported in the shoe holder so that the shoe can swing from a neutral position to forward and backward swing limits. The shoe is provided with return-to-neutral means for exhibiting a return force that makes the shoe return to the neutral position. The contact area between the shoe and the check plate is arranged so that the frictional force in the contact area becomes the smallest when the shoe reaches the shoe swing limits.

7 Claims, 9 Drawing Sheets

AUTOMOBILE DOOR CHECKER

BACKGROUND OF THE INVENTION

1. Field of the Invention

The present invention relates to an automobile door checker that is connected between a body and a door of an automobile and that controls the opening and closing torque of the door in order to maintain the door at a predetermined opening position and, in particular to an improvement of a door checker that includes a case secured to one of the body and the door of the automobile, a check plate that runs movably through the ease and is connected to the other of the body and the door, a shoe holder that is held by the case and is able to move toward and away from the check plate, a shoe that is held by the shoe holder and the shoe slides on the check plate accompanying relative movement between the case and the check plate, and a check spring that resiliently urges the shoe holder toward the check plate within the case in order to press the shoe against the check plate.

2. Description of the Related Art

Conventionally, in such a door checker, as disclosed in Japanese Patent Publication No. 3-13392, a detent notch, with which a shoe engage is formed on the check plate, and an engagement force between the detent notch and the shoe holds the door stationary at a defined degree of opening.

In the above-mentioned conventional arrangement, since the degree of opening at which the door is held is defined in a stepped manner, the door cannot be held stationary at a position other than the defined degree of opening.

It is conceivable that, by setting a large check spring load so as to increase the frictional force between the shoe and the check plate and not providing a detent notch in the check plate, the door could be held stationary at any degree of opening. However, in such an arrangement, the operating load during opening and closing of the door also increases, and opening and closing operations of the door cannot be carried out easily, without overcoming the frictional force of the large check spring.

SUMMARY OF THE INVENTION

The present invention has been achieved under the above-mentioned circumstances, and it is an object thereof to provide an automobile door checker that can reliably hold a door stationary at any degree of opening, and allows the door to be opened and closed easily, by decreasing the operating load when opening and closing of the door is started.

In order to achieve this object, in accordance with a first aspect of the present invention, there is provided an automobile door checker that includes a case secured to one of a body and a door of an automobile, a check plate that runs movably through the case and is linked to the other of the body and the door, a shoe holder that is held by the case and is able to move toward and away from the check plate, a shoe that is held by the shoe holder and the shoe slides on the check plate accompanying relative movement between the case and the check plate, and a check spring that resiliently urges the shoe holder toward the check plate within the case in order to press the shoe against the check plate, wherein the shoe is axially supported in the shoe holder so that the shoe can swing from a neutral position to forward and backward swing limits along the lengthwise direction of the check plate, wherein return-to-neutral means for exhibiting a return force that makes the shoe return to the neutral position is connected to the shoe, and wherein the contact area between the shoe and the check plate is arranged so that the frictional force in the contact area becomes the smallest when the shoe reaches the shoe swing limits compared to that of when the shoe is operated within the swing limits.

In accordance with this first aspect, when the door is in a load-free state at a given degree of opening, the shoe is held at the neutral position by the action of the return-to-neutral means, and a large frictional force is generated in the contact area between the shoe and the check plate, thereby enabling the door to be held stationary at the given degree of opening. Furthermore, when an operating force having a certain value or more is applied to the door in the opening or closing direction, the shoe is swung to the swing limit or the vicinity thereof, thus reducing the frictional force in the contact area between the shoe and the check plate, so that the shoe can slide smoothly over the check plate, and the door can be opened and closed easily.

Furthermore, in accordance with a second aspect of the present invention, in addition to the first aspect, there is provided an automobile door checker having a return-to-neutral means which includes a recess formed in the shoe, an engagement member that engages with the recess, and a return spring for urging the engagement member in a direction in which the engagement member engages with the recess, the recess having an inclined face that, accompanying swinging of the shoe from the neutral position toward the swing limits, pushes the engagement member upward in order to generate the return force by increasing the repulsive force of the return spring.

In accordance with this second aspect, a required return-to-neutral farce for the shoe can be obtained easily by adjustably setting the angle of the inclined face of the recess.

The above-mentioned object, other objects, characteristics, and advantages of the present invention will become apparent from an explanation of preferred embodiments that will be described in detail below with reference to the attached drawings.

DESCRIPTION OF THE PREFERRED EMBODIMENTS

Figure 1:
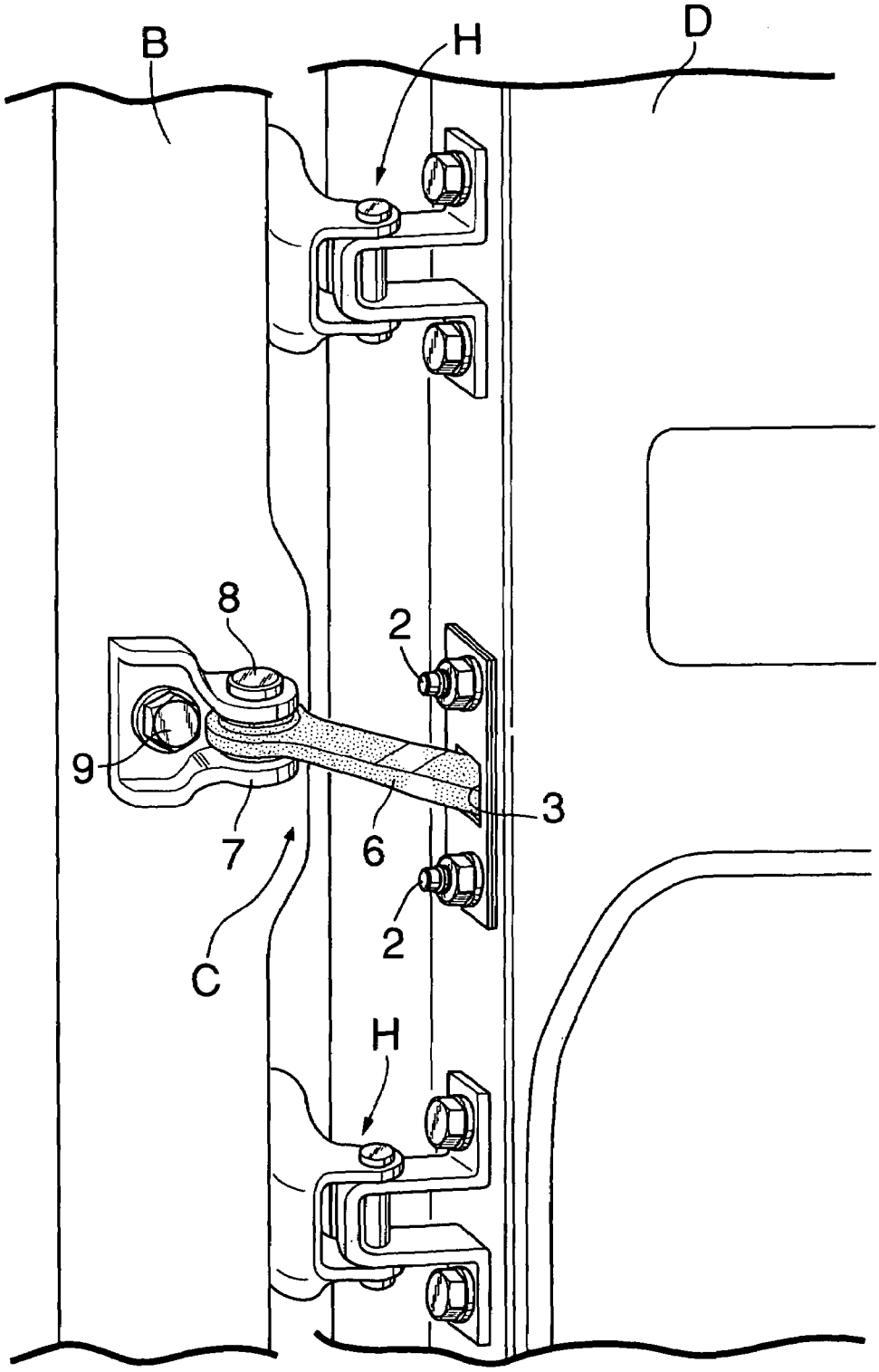
FIG. 1 is a perspective view of an essential part of an automobile equipped with a door checker according to a first embodiment of the present invention.

In FIG. 1, a door D is pivotably mounted to a body B of an automobile via a pair of upper and lower hinges H so as to open and close an entrance of the body B, and a door checker C of the present invention is mounted on the body B and the door D between the two hinges H.

Figure 2:
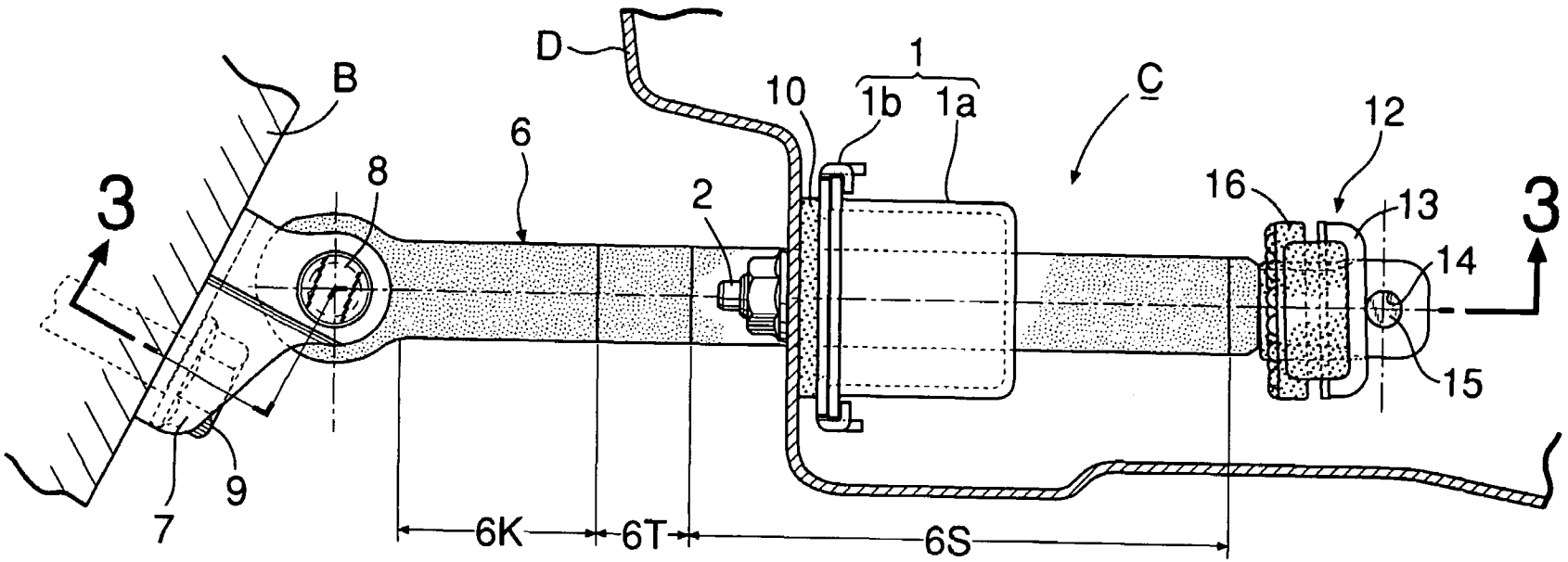
FIG. 2 is a plan view of the door checker.
Figure 3:
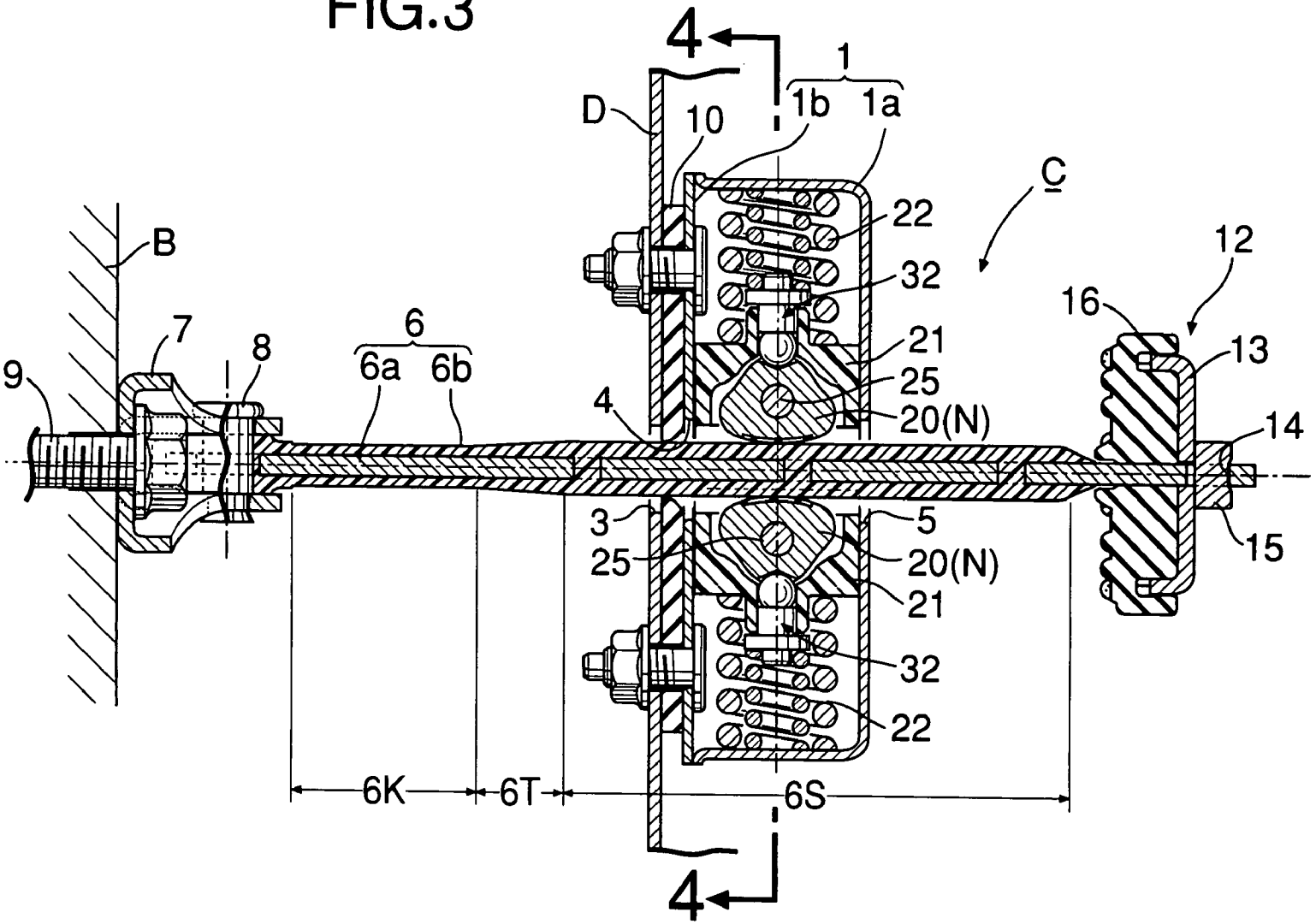
FIG. 3 is a sectional view along line 3—3 in FIG. 2.

As shown in FIG. 2 and FIG. 3, the door checker C has a case 1 secured to an inner face of an end wall of the door D by bolts 2. This case 1 is formed from a case main body 1*a* having a box shape with one end thereof open, and a cover 1*b* covering the open end and secured to the end wall of the door D by the bolts 2. Through holes 4 and 5 are bored in the cover 1*b* and the case main body 1*a*, and arranged coaxially with a through hole 3 that opens in the end wall of the door D. A bracket 7 and the base end of a check plate 6 running through these three through holes 3, 4, and 5 are pivotably connected to each other via a pivot 8. This bracket 7 is secured to the body B by a bolt 9 with the pivot 8 parallel to the pivot axis of the hinge H. In this arrangement, a sealing plate 10 for sealing a gap between the through hole 3 and the check plate 6 is disposed between the cover 1*b* and the end wall of the door D.

The check plate 6 is formed from a steel core plate 6*a* connected directly to the bracket 7 and a synthetic resin cover body 6*b* mold-bonded to the periphery of the core plate 6*a* excluding a free end portion thereof.

Provided on the free end portion of the check plate 6 is fully open stopper means 12 for defining the open limit of the door D. This fully open stopper means 12 is formed from a stopper plate 13 through which the free end portion of the check plate 6 runs, a stopper pin 15 press-fitted in a pin opening 14 bored in the free end portion of the check plate 6 and supporting the back face of the stopper plate 13, and a rubber cushion member 16 supported on the front face of the stopper plate 13. When the door D pivots to its fully opened position, the end wall of the case 1 is caught by the stopper plate 13 via the cushion member 16, thereby defining the fully opened position of the door D.

The check plate 6 is provided with a relatively thin base end region 6K, a thick main region 6S, and an intermediate region 6T that connects side faces of these regions 6K and 6S by an inclined face. The size of the regions along the lengthwise direction of the check plate 6 increases in the order: middle region 6T; base end region 6K; and main region 6S.

Figure 4:
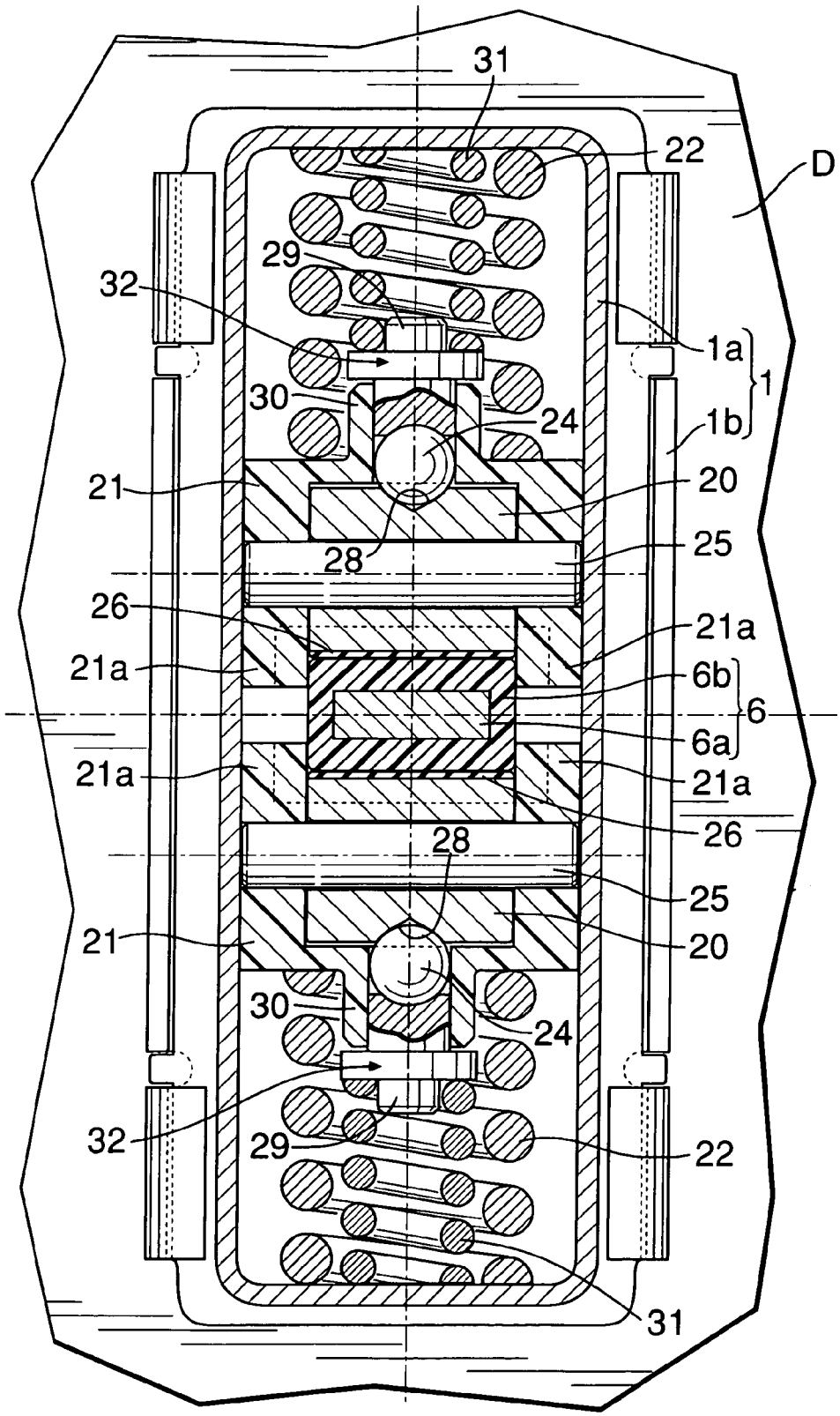
FIG. 4 is an enlarged sectional view along line 4—4 in FIG. 3.
Figure 5:
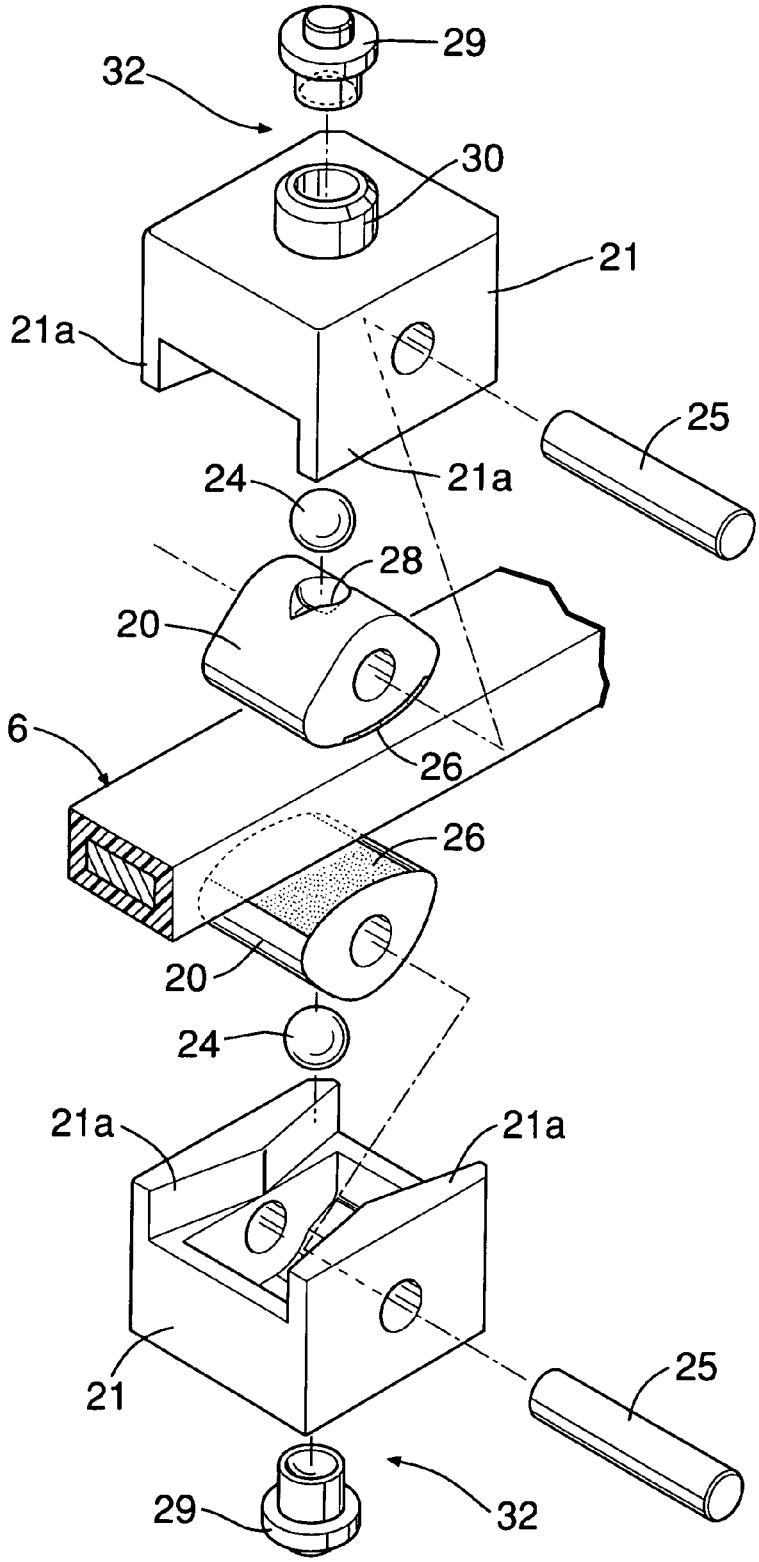
FIG. 5 is an exploded view of an essential part of the door checker.
Figure 6:
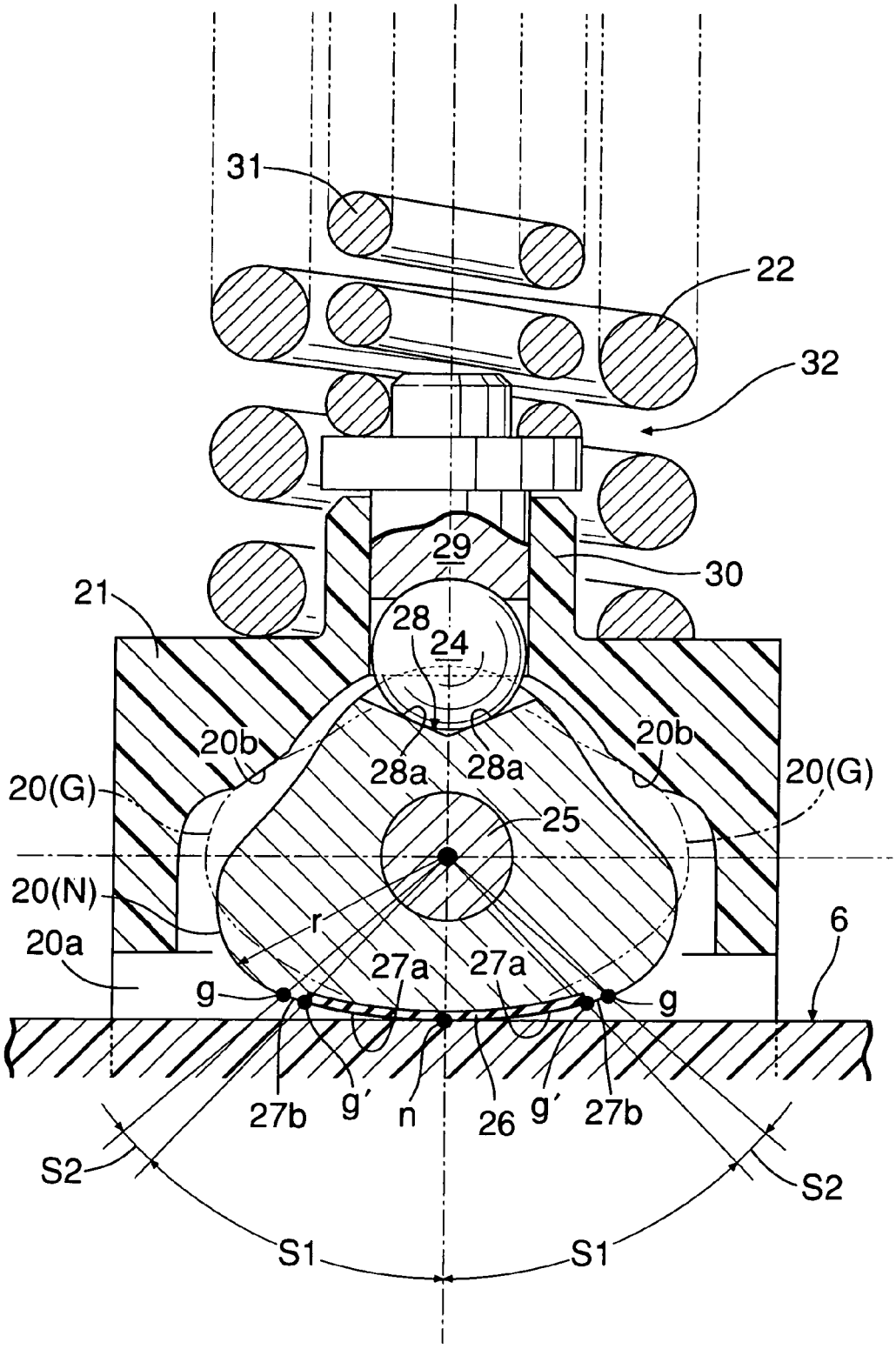
FIG. 6 is an enlarged view of an essential part of FIG. 3.

As shown in FIG. 4 to FIG. 6, housed within the case 1 are a pair of synthetic resin shoes 20 that are disposed so as to sandwich the check plate 6 in its thickness direction and that can slide on opposite broad side faces of the check plate 6, a pair of shoe holders 21 slidably fitted within the case 1 so that they can move toward and away from the check plate 6 while holding these shoes 20, and a pair of check springs 22 provided under compression between these shoe holders 21 and the inner wall of the case 1 and resiliently urging the shoe holders toward the check plate 6. Each of the shoe holders 21 has a pair of guide walls 21*a* in sliding contact with opposite narrow side faces of the check plate 6.

As is clearly shown in FIG. 6, each of the shoes 20 is made of a metal or a hard synthetic resin, and is supported by a pivot 25 mounted on the shoe holder 21 so that the shoe 20 can swing forward and backward from the neutral position N along the lengthwise direction of the check plate 6. A pair of stopper walls 20*b* are formed on the shoe holder 21, the stopper walls 20*b* defining forward and backward swing limits G by receiving the side face on the swinging side of the shoe 20 when it swings in the forward and backward directions from the neutral position N through a fixed angle.

The face of each of the shoes 20 that contacts the check plate 6 is formed so that a distance r between the contact face and the center of the pivot 25 increases from the neutral position N of the shoe 20 toward the forward and backward swing limits G. Therefore, when each of the shoes 20 swings toward the forward or backward swing limit G from the neutral position N while maintaining a state of contact with the check plate 6, the shoe holder 21 accordingly moves, via the pivot 25, in a direction away from the check plate 6, thus compressing the check spring 22 and increasing the spring load thereof.

In the face of the shoe 20 that contacts the check plate 6, the contact point of the shoe 20 at which it makes contact with the check plate 6 when the shoe 20 is at the neutral position N is defined as n, the contact point of the shoe 20 at which it makes contact with the check plate 6 when the shoe 20 is at the swing limit G is defined as g, a contact point in the vicinity of g is defined as g', a wide section from n to g' is defined as a first segment S1, and a narrow section from g' to g is define as a second segment S2. It is arranged so that when the shoe 20 makes contact with the check plate 6 in the first segment S1, a relatively large frictional force is generated therebetween, and when the shoe 20 makes contact with the check plate 6 in the second segment S2, as small a frictional force as possible is generated therebetween. Specifically, the face of the first segment S1 of the shoe 20 that contacts the check plate 6 is formed as a high frictional coefficient surface 27*a* by embedding a high friction material 26 such as rubber in that section, and the face of the second segment S2 of the shoe 20 that contacts the check plate 6 is formed as a mirror-finished low frictional coefficient surface 27*b*.

Formed on the shoe 20 is a recess 28 on the side opposite to the face that contacts the check plate 6. A ball-shaped engagement member 24 that engages with the recess 28 and a retainer 29 that abuts against the engagement member 24 so as to press it toward the recess 28 are slidably fitted in a guide tube 30 formed in a central part of the shoe holder 21. A return spring 31 that urges the retainer 29 toward the engagement member 24 is provided under compression between the retainer 29 and the inner wall of the case 1, the check spring 22 surrounding the return spring 31.

The recess 28 has a pair of front and rear inclined faces 28*a* that rise along the swing direction of the shoe 20 from the bottom portion; when the shoe 20 is at the neutral position N, the engagement member 24 is positioned at the bottom portion of the recess 28 so as to make contact with the two inclined faces 28*a*, and when the shoe 20 swings from the neutral position N toward the forward or backward swing limit G the engagement member 24 climbs one of the front and rear inclined faces 28*a*, thereby increasing the repulsive force of the return spring 31 and thus generating a return-to-neutral force to urge the shoe 20 toward the neutral position N. Therefore, the recess 28, the engagement member 24, the retainer 29, and the return spring 31 in cooperation form return-to-neutral means 32 for always urging the shoe 20 toward the neutral position N.

The operation of this embodiment is now explained.

When the door D is at a given intermediate degree of opening in a no-load state, as shown in FIG. 6, the shoe 20 is maintained at the neutral position N by the engagement member 24 of the return-to-neutral means 32 being pressed against the two opposing inclined faces 28*a* of the recess 28 of the shoe 20 by virtue of the urging force of the return spring 31. Since this shoe 20 presses the high frictional coefficient surface 27*a* against the check plate 6 by means of the urging force of the check spring 22, a large frictional force is generated between the shoe 20 and the check plate 6, and the door D can be held stationary at any degree of opening by means of the frictional force.

Figure 7:
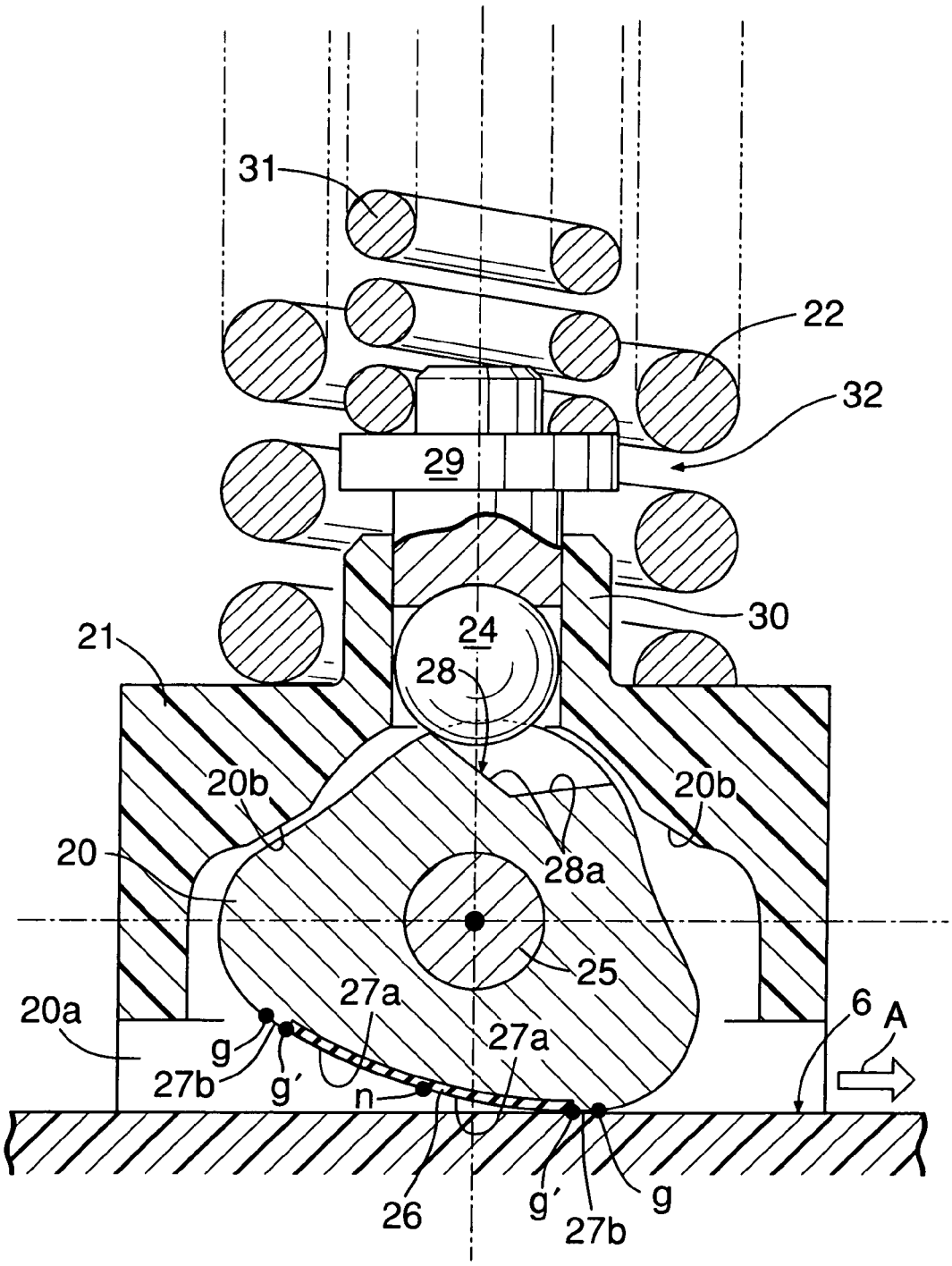
FIG. 7 is a diagram, corresponding to FIG. 6, for explaining an operation.

In this state, when the case 1 secured to the door D is moved in the direction of the arrow A relative to the check plate 6 on the body B side as shown in FIG. 7 by applying to the door D an operating force in a direction to open or close the door D, the shoe 20 in contact with the check plate 6 with a large frictional force, at first, swings around the pivot 25 so as to roll on the check plate 6. As the swing angle increases, the distance r between the face of the shoe 20 that is in contact with the check plate 6 and the center of the pivot 25 increases, so that the pivot 25 moves together with the shoe holder 21 in a direction away from the check plate 6, and the load of the check spring 22, that is, the repulsive force increases, resulting in that the return-to-neutral force on the shoe 20 increases.

In the return-to-neutral means 32, accompanying the swing of the shoe 20, the engagement member 24 is pushed upward so as to climb one of the inclined faces 28*a* of the recess 28 of the shoe 20, thus increasing the load, that is, the repulsive force of the return spring 31 via the retainer 29 and thereby increasing the return-to-neutral force applied to the shoe 20.

Moreover, while the shoe 20 is in contact with the check plate 6 through the first segment S1, the shoe 20 makes the high frictional coefficient surface 27*a* come into contact with the check plate 6 and slipping does not occur. Therefore, if an external force imposed on the door D is released while in the first segment S1, the shoe 20 is returned to the neutral position N by the return-to-neutral force due to the repulsive forces of the check spring 22 and the return spring 31. This indicates that the force holding the door D stationary is strong.

Figure 8:
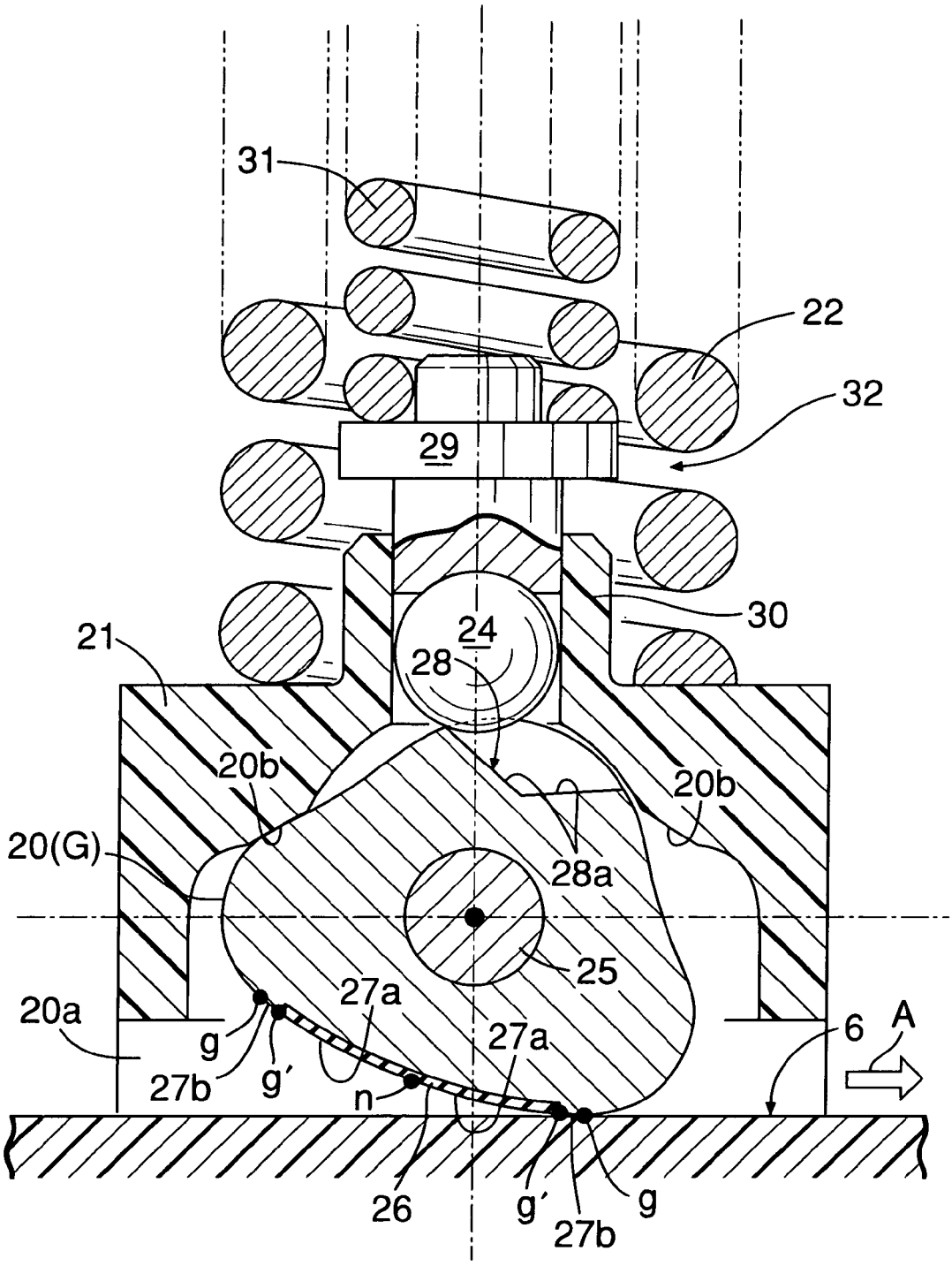
FIG. 8 is a diagram, corresponding to FIG. 6, for explaining another operation.

Subsequently, increasing the operating force to open or close the door D allows the face of the shoe 20 that is in contact with the check plate 6 to move from the first segment S1 to the second segment S2 as shown in FIG. 8, the low fictional coefficient surface 27*b* of the shoe 20 makes contact with the check plate 6, the frictional force therebetween rapidly decreases, the shoe 20 stops pivoting around the pivot 25 and starts slipping on the check plate 6, and as a result the door D can be opened or closed easily.

In this way, the door D can be held stationary at any degree of opening and, moreover, once the door D starts to move from its stationary position, the opening and closing operating force can be greatly reduced.

In the return-to-neutral means 32 formed from the recess 28 of the shoe 20, which has the pair of inclined faces 28*a*, the engagement member 24 that engages with the recess 28, and the return spring 31 urging the engagement member 24 in the direction in which it engages with the recess 28, setting the angle of the inclined faces 28*a* enables a required return-to-neutral force for the shoe 20 to be obtained easily, thus giving a high degree of freedom in the design.

Figure 9:
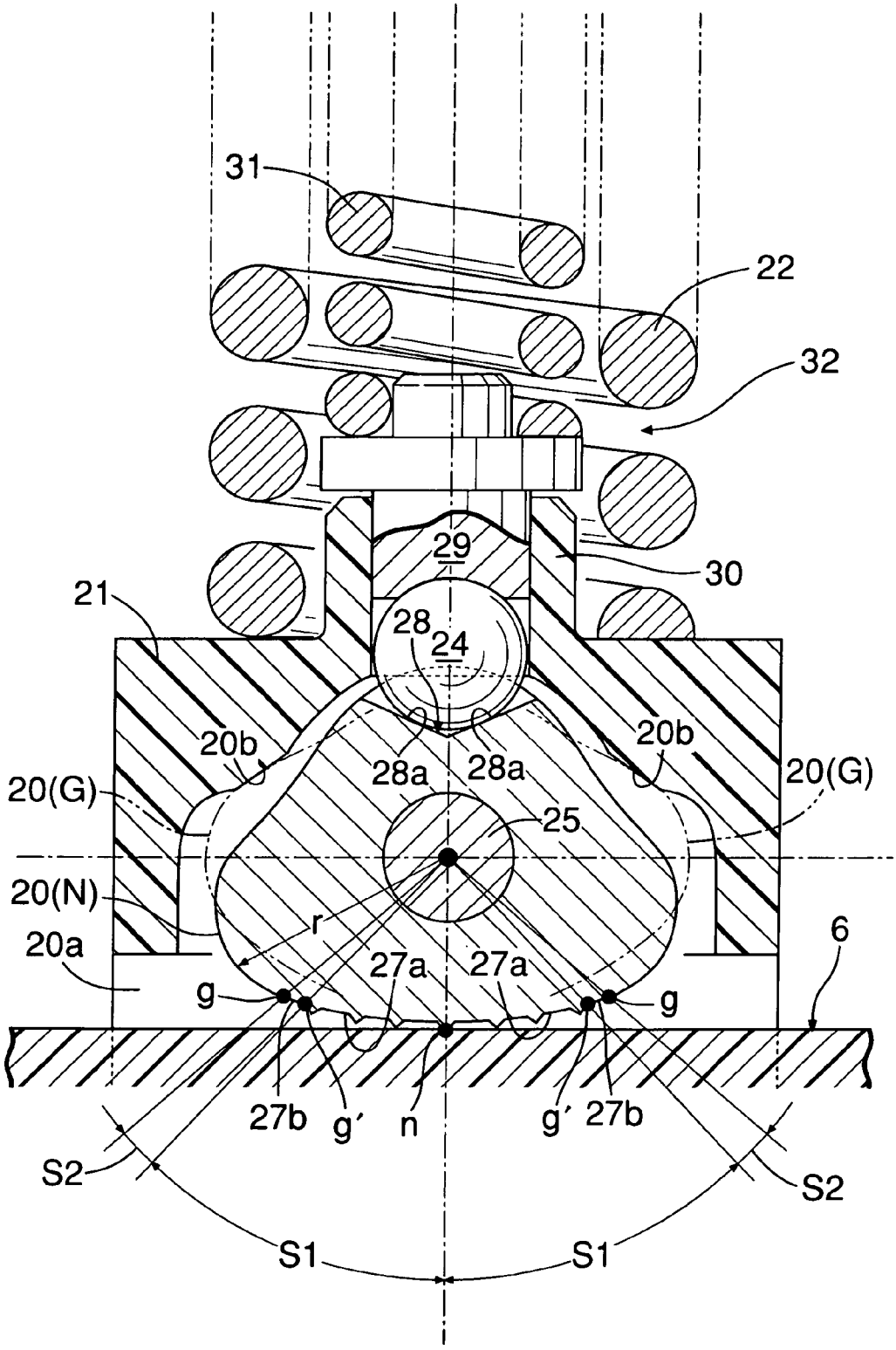
FIG. 9 is a view, corresponding to FIG. 6, of a second embodiment of the present invention.

A second embodiment of the present invention shown in FIG. 9 is now explained.

In the second embodiment a high frictional coefficient surface 27*a* of a shoe 20 is formed to be a rough knurled surface. The components in construction are the same as those of the first embodiment, and the same reference numerals and symbols as those used in the first embodiment are used in FIG. 9 to denote parts corresponding to the parts of the first embodiment, thereby avoiding duplication of the explanation.

The present invention is not limited to the above-mentioned embodiments and can be modified in a variety of ways without departing the subject matter of the present invention. For example, the case 1 may be secured to the body B, and the bracket 7 of the check plate 6 may be attached to the door D. It is also possible to employ, as the check spring 22 or the return spring 31, ones made of rubber.

What is claimed is:

1. An automobile door checker connected between a body and a door of an automobile, the door checker comprising:

a case secured to one of the body and the door;

a check plate that runs movably through the case and the check plate is linked to the other of the body and the door;

a shoe holder that is held by the case and the shoe holder is able to move towards and away from the check plate;

a shoe that is disposed in the shoe holder, the shoe comprising a first segment having a high frictional surface and a second segment having a low frictional surface for sliding on the check plate accompanying relative movement between the case and the check plate; and a check spring that resiliently urges the shoe holder toward the check plate within the case in order to press the shoe against the check plate;

wherein the shoe is axially supported in the shoe holder so that the shoe can swing from a neutral position to forward and backward swing limits along the lengthwise direction of the check plate;

wherein a return-to-neutral means for exhibiting a return force that makes the shoe return to the neutral position is connected to the shoe;

wherein the contact area between the shoe and the check plate is arranged so that the frictional force in the contact area becomes smallest when the shoe reaches the shoe swing limits; and wherein the first segment includes a surface formed by embedding material having a high frictional coefficient.

2. The automobile door checker of claim 1, wherein the second segment includes a surface formed by embedding a material having a low frictional material coefficient.

3. The automobile door checker according to claim 2, wherein the return-to-neutral means comprises a recess formed in the shoe; an engagement member that engages with the recess; and a return spring for urging the engagement member in a direction in which the engagement member engages with the recess, the recess having an inclined face such that accompanying swinging of the shoe from the neutral position toward the swing limits pushes the engagement member upward in order to generate the return force by increasing the repulsive force of the return spring.

4. The automobile door checker of claim 1, wherein the return-to-neutral means comprises a recess formed in the shoe; an engagement member that engages with the recess; and a return spring for urging the engagement member in a direction in which the engagement member engages with the recess, the recess having an inclined face such that accompanying swinging of the shoe from die neutral position towards the swing limits pushes the engagement member upward in order to generate the return force by increasing the repulsive force of the return spring.

5. An automobile door checker connected between a body and a door of an automobile, the door checker comprising:

a case secured to one of the body and the door;

a check plate that runs movably through the case and the check plate is linked to the other of the body and the door;

a shoe holder that is held by the ease and the shoe holder is able to move towards and away from the cheek plate;

a shoe that is disposed in the shoe holder and the shoe slides an the check plate accompanying relative movement between the case and the check plate; and a check spring that resiliently urges the shoe holder toward the check plate within the case in order to press the shoe against the check plate;

wherein the shoe is axially supported in the shoe holder so that the shoe can swing from a neutral position to forward and backward swing limits along the lengthwise direction of the check plate;

wherein a return-to-neutral means for exhibiting a return force that makes the shoe return to the neutral position is connected to the shoe; and wherein the return-to-neutral means comprises a recess formed in the shoe, an engagement member that engages with the recess, and a return spring for urging the engagement member in a direction in which the engagement member engages with the recess, the recess having an inclined face such that accompanying swinging of the shoe from the neutral position toward the swing limits pushes the engagement member upward in order to generate the return force by increasing the repulsive force of the return spring; and wherein the contact area between the shoe and the check plate is arranged so that the frictional force in the contact area becomes smallest when the shoe reaches the shoe swing limits.

6. An automobile door checker connected between a body and a door an automobile, the door checker comprising:

a case secured to one of the body and the door; and a check plate operatively situated in a center of the ease dividing the case into two halves and the cheek plate is linked to the other of the body and the door;

wherein each said half of the case comprises:

a shoe holder that is held by the case and the shoe holder is able to move towards and away from the check plate;

a shoe that is held by the shoe holder and the shoe slides on the check plate accompanying relative movement between the case and the check plate; and a cheek spring that resiliently urges the shoe holder toward the check plate within the case in order to press the shoe against the check plate;

wherein the shoe is axially supported in the shoe holder so that the shoe can swing from a neutral position to forward and backward swing limits along the lengthwise direction of the check plate;

wherein a return-to-neutral means for exhibiting a return force that makes the shoe return to the neutral position is connected to the shoe;

wherein the contact area between the shoe and the cheek plate is arranged so that the frictional force in the contact area becomes the smallest when the shoe reaches the shoe swing limits; and wherein the shoe comprises a segment having a high frictional surface formed by embedding material having a high frictional coefficient.

7. The automobile door checker of claim 6, wherein the return-to-neutral means comprises a recess formed in the shoe; an engagement member that engages with the recess; and a return spring for urging the engagement member in a direction in which the engagement member engages with the recess, the recess having an inclined face such that accompanying swinging of the shoe from the neutral position towards the swing limits pushes the engagement member upward in order to generate the return force by increasing the repulsive force of the return spring.

* * * * *